US005980137A

United States Patent [19]

Yano et al.

[11] Patent Number: 5,980,137

[45] Date of Patent: Nov. 9, 1999

[54] PRINTER FOR FACSIMILE MACHINE

[75] Inventors: Hidetoshi Yano, Tokai; Yoshikatsu Kameyama, Hashima, both of Japan

[73] Assignee: Brother Kogyo Kabushiki Kaisha, Nagoya, Japan

[21] Appl. No.: 09/005,779

[22] Filed: Jan. 12, 1998

[30] Foreign Application Priority Data

| | | | |
|---|---|---|---|
| Jan. 13, 1997 | [JP] | Japan | 9-003661 |
| Jan. 13, 1997 | [JP] | Japan | 9-003662 |
| Jan. 16, 1997 | [JP] | Japan | 9-005256 |

[51] Int. Cl.[6] ..... B41J 11/42

[52] U.S. Cl. ..... 400/579; 400/629; 271/10.09; 271/258.02

[58] Field of Search ..... 400/611, 624, 400/625, 629, 630, 633, 636.1, 636, 642, 231, 579; 101/228; 271/10.09, 226, 242, 243, 258.02

[56] References Cited

U.S. PATENT DOCUMENTS

| | | | |
|---|---|---|---|
| 3,878,781 | 4/1975 | Burkhardt et al. | 101/228 |
| 4,990,011 | 2/1991 | Underwood et al. | 400/629 |
| 5,052,831 | 10/1991 | Satoh et al. | 400/630 |
| 5,222,724 | 6/1993 | Hirano et al. | 400/636 |
| 5,226,741 | 7/1993 | Kumazaki et al. | 400/579 |
| 5,450,100 | 9/1995 | Yamada et al. | 400/231 |
| 5,542,769 | 8/1996 | Schneider et al. | 400/231 |
| 5,642,952 | 7/1997 | Tomatsu et al. | 400/630 |
| 5,678,488 | 10/1997 | Yamaguchi et al. | 400/624 |
| 5,738,457 | 4/1998 | Ishida et al. | 400/630 |

*Primary Examiner*—Eugene Eickholt

*Attorney, Agent, or Firm*—Oliff & Berridge, PLC

[57] ABSTRACT

In a printer for facsimile machines or the like, a forward end of paper to be fed is temporarily fixed between a platen roller and a print head before printing by the print head is started. A paper feed roller is then rotated so that an inclination of the paper is corrected. Guides are provided so that the paper is fed in a direction of a tangential line of the platen roller at a holding point between the platen roller and the print head.

11 Claims, 6 Drawing Sheets

PRINTER FOR FACSIMILE MACHINE

BACKGROUND OF THE INVENTION

1. Field of the Invention

This invention relates generally to a printer suitable for use in facsimile machines or the like, and more particularly to such a printer comprising a platen roller and a print head between which a sheet of paper and an ink ribbon are held so that images are printed on the paper.

2. Description of the Related Art

A facsimile machine for transmitting and receiving via a telephone line images such as characters or figures described or illustrated on one or more original sheets generally comprises an image reader for reading images on the original as image information, a printer for printing the read image information on paper, and a transmission-reception device for transmitting and receiving via the telephone line the image information. The printer includes a print head disposed to extend along a width of paper on which images are to be printed, a platen roller disposed to hold the paper and an ink ribbon between it and the print head, and a paper feeding roller for feeding the paper between the print head and the platen roller. The platen roller is rotated with the print head being pressed thereagainst so that images are printed on the paper while the paper and ink ribbon are being fed. In this case, the characters or figures printed on the paper are inclined when the paper is inclined relative to the print head. Moreover, a part of the images are inconveniently printed out of the paper when an inclination of the paper is large.

To solve the above-described problem, the prior art has provided a resist roller disposed in a feed passage along which the paper is fed by the paper feeding roller until reaching the location between the print head and the platen roller. When a forward end of the paper is temporarily fixed by the resist roller, the paper is flexed so that an inclination thereof is corrected. Thereafter, the resist roller is rotated to feed the paper.

In the above-described construction, however, the resist roller and a drive mechanism therefor are required to correct the inclination of the paper. The number of parts is thus increased. Furthermore, since the resist roller is disposed away from the print head, it takes a predetermined time for the paper to be fed from the resist roller to the print head after the inclination of the paper has been corrected. Accordingly, it is difficult to adjust a paper feed start timing and a print start timing. An insufficient adjustment of these timings results in a waste of ink ribbon or a reduction in an accuracy in determining the printing position.

SUMMARY OF THE INVENTION

Therefore, an object of the present invention is to provide a printer wherein the inclination of paper can be corrected by addition of a smaller number of parts, and the paper feed start timing and the print start timing can readily be adjusted after the correction of paper inclination.

The present invention provides a printer comprising a platen roller, a print head holding paper between the same and the platen roller, thereby printing images on the paper, and paper inclination correcting means for feeding the paper while a forward end of the paper is being held between the platen roller and the print head, so that the paper is flexed, thereby correcting an inclination of the paper.

According to the above-described construction, the platen roller serves as the conventional resist roller to fix the forward end of the paper. Consequently, the number of parts and accordingly the manufacturing cost of the printer can be reduced. Furthermore, the forward end of the paper is in abutment against the platen roller when the paper is re-fed after completion of adjustment of paper inclination. In this state, a printing start timing is readily linked with a paper feeding start timing by the drive of the platen roller. Consequently, the accuracy in determining the printing position can be improved and the waste of the ink ribbon can be prevented.

The paper inclination correcting means preferably has a function of interrupting rotation of the platen roller when a forward end of the paper is held between the platen roller and the print head. In the conventional construction, the resist roller in rotation is stopped and the forward end of the paper is then fixed. A drive system and a control system for the resist roller in the conventional construction can be diverted to those for the platen roller in the adjustment of paper inclination. Consequently, designing and development costs can be reduced.

The printer preferably further comprises winding means for winding an ink ribbon and control means releasing the forward end of the paper from a fixed state by the paper inclination correcting means and synchronizing a rotation start timing of the platen roller with a winding start timing of the winding means. Furthermore, the control means preferably synchronizes the rotation start timing of the platen roller with a winding start timing of the winding means, based on that a forward end of the paper extends along the platen roller. Since the feeding start timings of the ink ribbon and the paper are reliably synchronized with each other, an amount of wasted ink ribbon can be reduced.

The printer preferably further comprises paper detecting means provided midway in a feed passage of the paper to the platen roller for detecting pass of the paper therethrough, thereby generating a detection signal. In this construction, the control means obtains an amount of flexure of the paper, based on the detection signal generated by the paper detecting means. Since an accurate amount of flexure of the paper is obtained from the detection signal, the accuracy in determining the printing position can further be improved.

The printer preferably further comprises guide means for guiding the paper so that the paper is fed in a direction of a tangential line of the platen roller at a holding point where the paper and an ink ribbon are held between the platen roller and the print head, toward the holding point. The forward end of the paper can reliably be fixed in the vicinity of the holding point between the platen roller and the print head even when the thickness varies from paper to paper or the paper is partially rolled.

The guide means preferably guides the paper to the holding point substantially parallel with the ink ribbon. In this case, a film member is preferably disposed to extend from a location near the holding point at least to another location where the paper is substantially parallel with the ink ribbon. Consequently, the paper can be prevented from becoming dirty due to the contact with the ink ribbon until the paper reaches the holding point.

The guide means preferably comprises a first guide member having an abutment portion abutted against one of opposite sides of the paper located at the ink ribbon side and a second guide member having an abutment portion abutted against the other side of the paper. In this construction, the abutment portion of the second guide member is preferably located between the abutment portion of the first guide member and the platen roller.

The printer preferably further comprises a paper feed roller, and the abutment portion of the first guide member is preferably located at one side of a plane defined between the holding point and the forward end of the paper fed past the paper feed roller and the abutment portion of the second guide member is located at the other side of the plane.

BRIEF DESCRIPTION OF THE DRAWINGS

Other objects, features and advantages of the present invention will become clear upon reviewing the following description of preferred embodiments thereof, made with reference to the accompanying drawings, in which.

DETAILED DESCRIPTION OF THE PREFERRED EMBODIMENT

Figure 1:
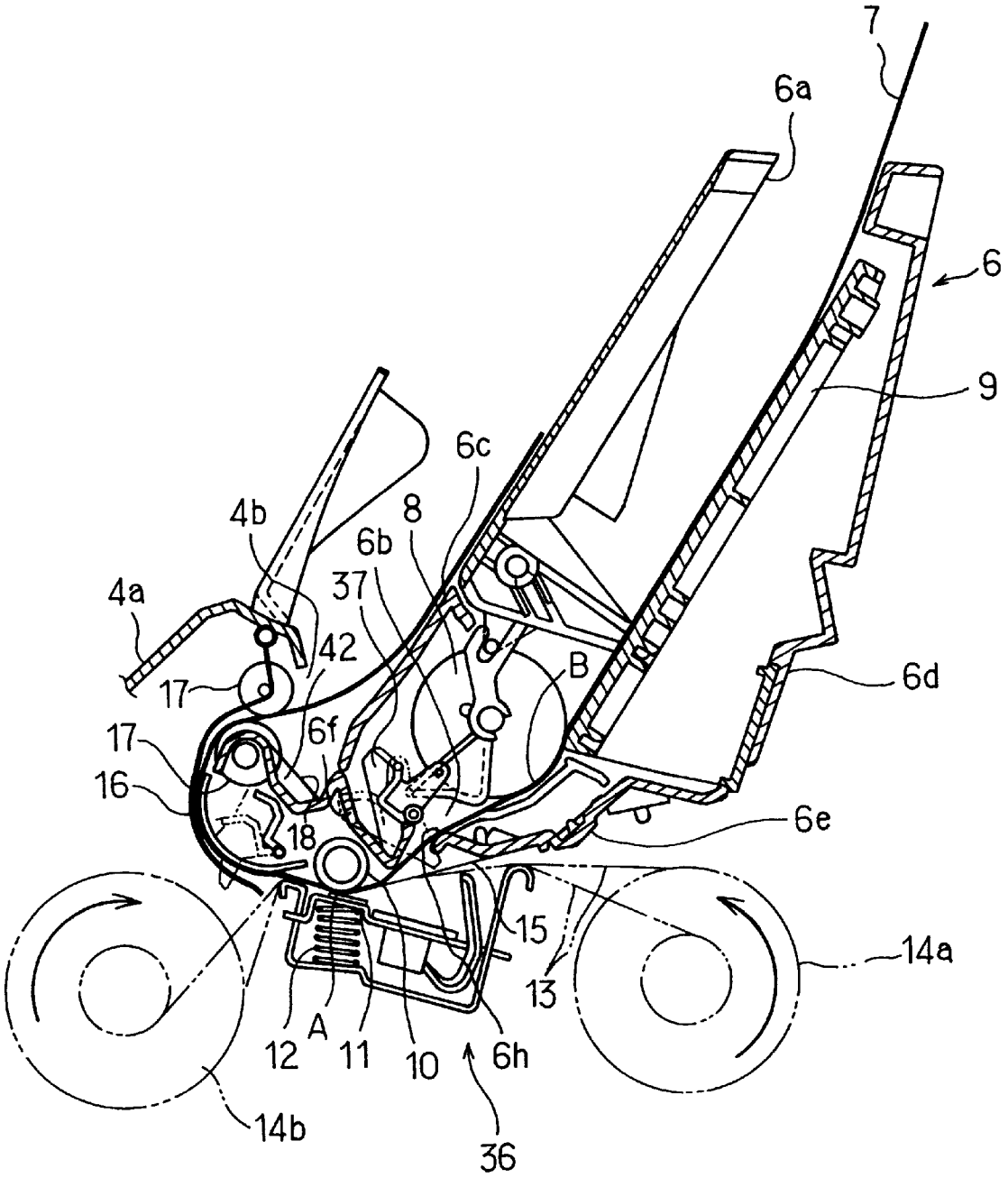
FIG. 1 is a partial enlarged longitudinal side section of the facsimile machine to which one embodiment of the printer in accordance with the present invention is applied, showing a paper inlet and its peripheral portion of the facsimile machine.
Figure 2:
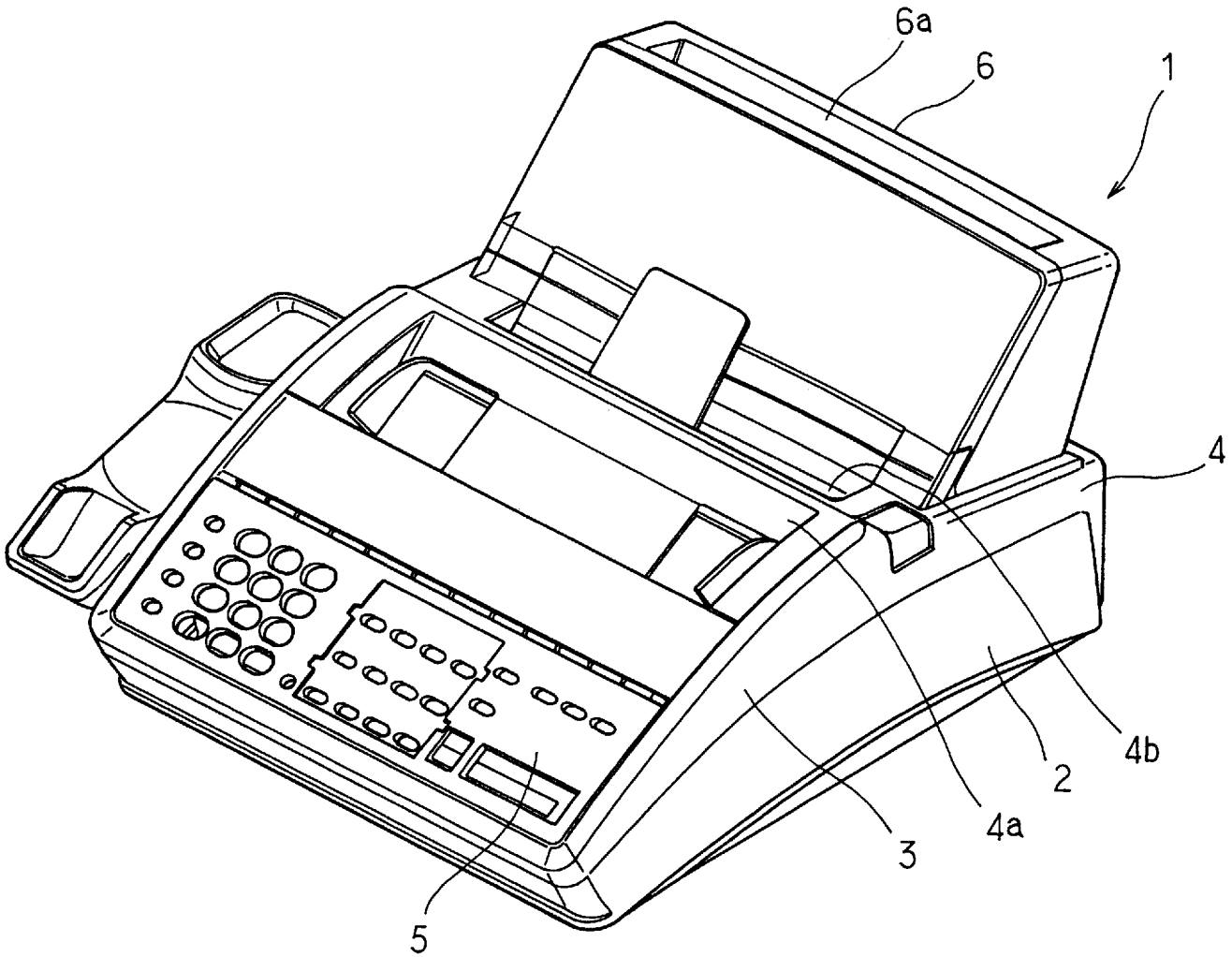
FIG. 2 is a perspective view of the facsimile machine.

One embodiment of the present invention will be described with reference to the accompanying drawings. In the embodiment, the printer of the invention is applied to a facsimile machine of the business use type. Referring first to FIG. 2, the facsimile machine 1 is shown. The facsimile machine comprises an accommodation frame 2 constituting a lower casing. A panel cover 3 and a paper cover 4 for an original carrying image information to be transmitted are mounted respectively on the front and the rear of the frame 2 to be opened and closed. An operation panel 5 is mounted on the panel cover 3. The operation panel 5 includes input keys for telephone numbers, functions keys, etc. The paper cover 4 includes an original insertion guide 4*a*, a paper outlet 4*b* for discharging printed paper, and a paper retaining frame 6 accommodating a number of sheets of paper (only one sheet of paper is shown in FIGS. 1 and 2), disposed in this order from the front side.

Figure 3:
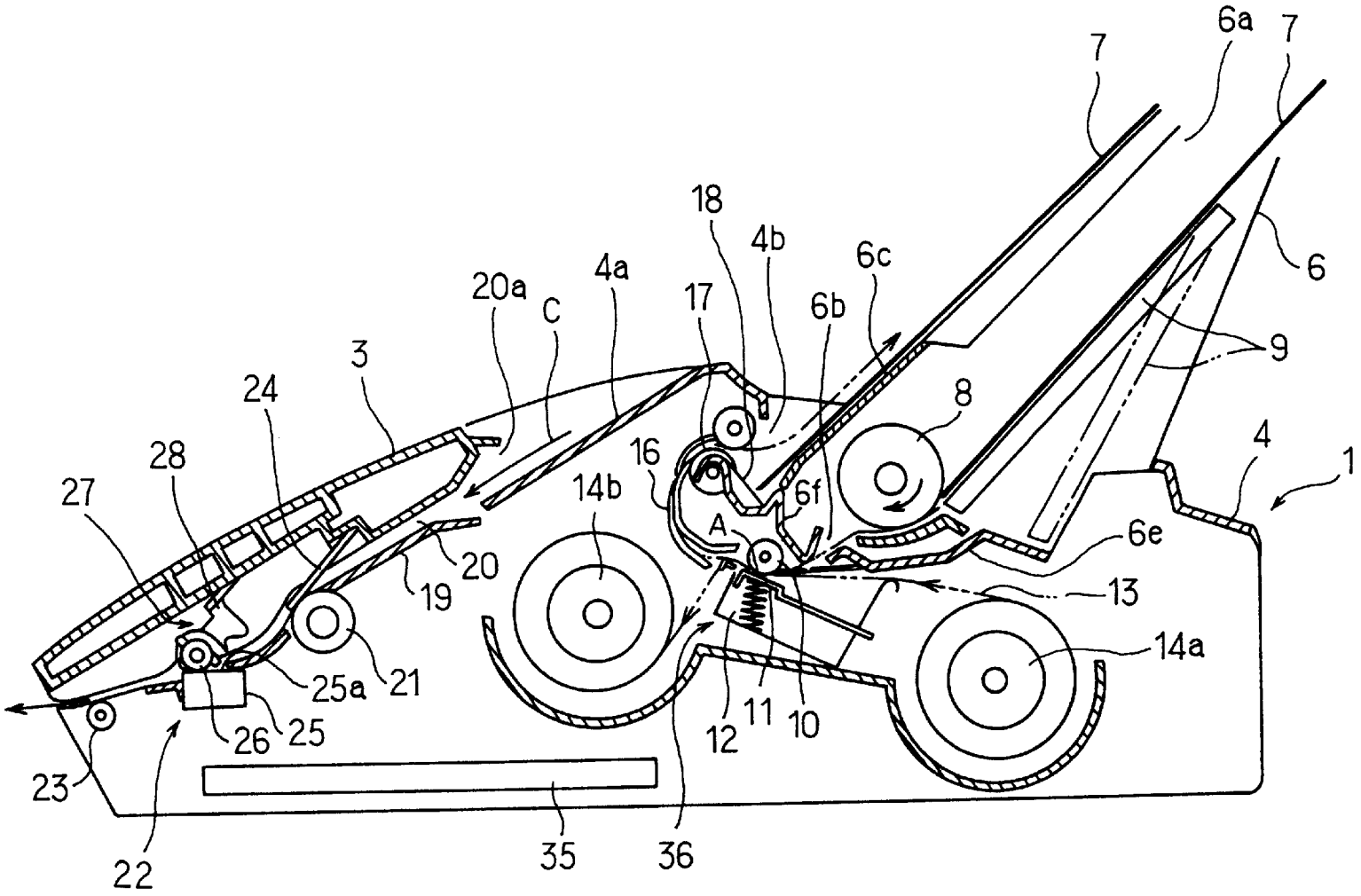
FIG. 3 is a longitudinal side section of the facsimile machine.

Referring to FIG. 3, an original insertion hole 20*a* is formed between a lower portion of the original insertion guide 4*a* and an upper portion of the panel cover 3. The original insertion guide 4*a* is inclined so that the gravity moves an original (not shown) forward or obliquely downward when the original is placed on the original insertion guide 4*a*. A paper chute cover 19 and the panel cover 3 are disposed in front of the original insertion guide 4*a*. The panel cover 3 is pivotally supported at its end at the guide 4*a* side as to be closed and opened. When closed, the panel cover 3 defines an original feed passage 20 together with the paper chute cover 19.

A feed roller 21, an image reader 22 and a paper discharge roller 23 are provided in the original feed passage 20 in this order from the hole 20*a* side. A separating strip 24 is pressed against the feed roller 21 so that a plurality of sheets of original paper, when inserted into the original insertion hole 20*a*, are fed one by one to the image reader 22.

The image reader 22 comprises an image sensor 25 further comprising a contact image sensor (CIS) and a reading platen roller 26 colored white, which color is used as a reference color. The image sensor 25 has an image reading face 25*a* having a width which is approximately the same as that of the original and reads images per line on the original, thereby delivering image information. Locking mechanisms 27 are provided on both ends of the image reading platen roller 26 respectively. Each locking mechanism 27 includes a platen support 28 for pressing the platen roller 26 against the image reading face 25*a* of the image sensor 25 and departing the platen roller 26 from the image reading face 25*a*.

The paper retaining frame 6 is formed with an upper paper inlet 6*a* and a lower paper inlet 6*b* communicating with the upper paper inlet 6*a*, as shown in FIGS. 2 and 3. A paper feed roller 8 is rotatably mounted in the vicinity of the paper inlet 6*b* in the paper retaining frame 6. A paper support plate 9 is also provided in the paper retaining frame 6 for supporting sheets of paper 7. The paper support plate 9 is pivotally mounted at an upper end thereof so that a lower end thereof is rotatively moved to be adjacent the paper feed roller 8. The paper support plate 9 is further urged to be rotatively moved toward the paper feed roller 8. The paper feed roller 8 is rotated with the lower end of the paper 7 pressed against the roller a by the paper support plate 9 so that the sheets of paper 7 are fed one by one to the paper inlet 6*b*.

A printer 36 is provided in the accommodation frame 2 so as to be located below the paper inlet 6*b*. The printer 36 comprises a printing platen roller 10 and a print head 11 located below the platen roller 10. The platen roller 10 is disposed so as to extend in the direction of the width of the paper 7 or so as to cross a direction of feed of the paper 7. The platen roller 10 has a length approximately equal to or slightly larger than the width of the paper 7. The print head 11 has a printing face for printing on the entire range of the paper in the direction of the width thereof. The print head 11 is urged by a compression coil spring 12 to be pressed against the printing platen roller 10. The paper 7 fed through the paper inlet 6*b* is held at a holding point A between the platen roller 10 and the print head 11 as shown in FIG. 3.

An ink ribbon 13 having a width approximately the same as that of the paper 7 is also fed to the holding point A. An unwinding roller 14*a* on which the ink ribbon 13 is wound is provided in the rear of the printer 36 or in the right of the printer in FIG. 3 in the accommodation frame 2. A winding roller 14*b* is provided in front of the printer 36 or in the left of the printer 36 in FIG. 3 for winding the ink ribbon 13 thereon. The ink ribbon 13, after being fed from the roller 14*a*, passes the holding point A at the lower side of the paper 7 or at the print head 11 side, thereafter being wound up on the winding roller 14*b*. The ink ribbon 13 is held at the holding point A between the platen roller 10 and the print head 11 together with the paper 7 so that the ink ribbon is located at the print head 11 side of the paper 7. The ink ribbon 13 is heated by the print head 11 at the holding point A so that image information is printed on the print head side or a printing side of the paper 7, as well known in the art. In the embodiment, the ink ribbon 13 is fed toward the holding point A in a direction of a tangential line of the platen roller 10 at the holding point A.

The construction of the facsimile machine around the paper inlet 6*b* will be described. Referring to FIG. 1, a first guide member 6*e* is provided on a lower end of a rear wall 6*d* of the paper retaining frame 6. The first guide member 6*e* extends below the paper feed roller 8. A second guide member 6*f* is provided at a lower end of a front wall 6*c* of the paper retaining frame 6. The second guide member 6*f* extends forward or in the left in FIG. 1 and rearward or in the right in FIG. 1. Each of the first and second guide members 6*e* and 6*f* has a width approximately equal to that of the paper 7. The paper inlet 6*b* is defined between a front end of the first guide member 6*e* and a rear end of the second guide member 6*f*.

The first guide member 6*e* is bent at a plurality of portions thereof and has a distal end 6*h* adapted to be abutted against the printing side of the paper 7, as shown in FIG. 1. The distal end 6*h* thus serves as an abutment portion of the first guide member 6*e*. A rear portion of the second guide member 6*f* extends rearwardly downward and is then bent upward so that a top 6*g* thereof is abutted against the other side (upper side in FIG. 1 ) of the paper 7. The top 6*g* of the second guide member 6*f* serves as an abutment portion thereof.

The distal end 6*h* of the first guide member 6*e* is located at one side of a plane defined between the holding point A and a position (shown by B in FIG. 1) where the paper 7 is fed past the paper feed roller 8 or at the paper feed roller 8 side. The top 6*g* of the second guide member 6*f* is located at the other side of the plane or at the ink ribbon 13 side. The paper 7 fed past the paper feed roller 8 to the paper inlet 6*b* is guided by the distal end 6*h* of the first guide member 6*e* and the top 6*g* of the second guide member 6*f* toward the holding point A in the direction of the tangential line of the platen roller 10 at the holding point A so as to be gently curved.

A film member 15 made of a plastic material is bonded to a portion of the underside of the first guide member 6*e* backwardly away from the front end thereof. The film member 15 has a width approximately equal to that of the ink ribbon 13 and such a length that it extends from near the holding point A.

A paper detecting member 37 is rotatably provided in the paper feed passage between the paper feed roller 8 and the holding point A. The paper detecting member 37 is rotatively moved when the forward end of the paper 7 is abutted thereagainst. The rotative movement of the paper detecting member 37 is detected by a paper sensor (not shown) comprising a photo sensor such as a photo interrupter or a microswitch.

A paper discharge guide 16 and two pairs of discharge rollers 17 are provided in a paper feed passage between the platen roller 10 and print head 11, and the paper outlet 4*b*. The paper discharge guide 16 guides the paper 7 having passed through the holding point A. The discharge rollers 17 discharge the paper 7 into the paper outlet 4*b* and are disposed at the right-hand and left-hand sides with respect to the center of the width of the paper outlet 4*b*. Only one pair of discharge rollers 17 are shown in FIG. 1.

Figure 4:
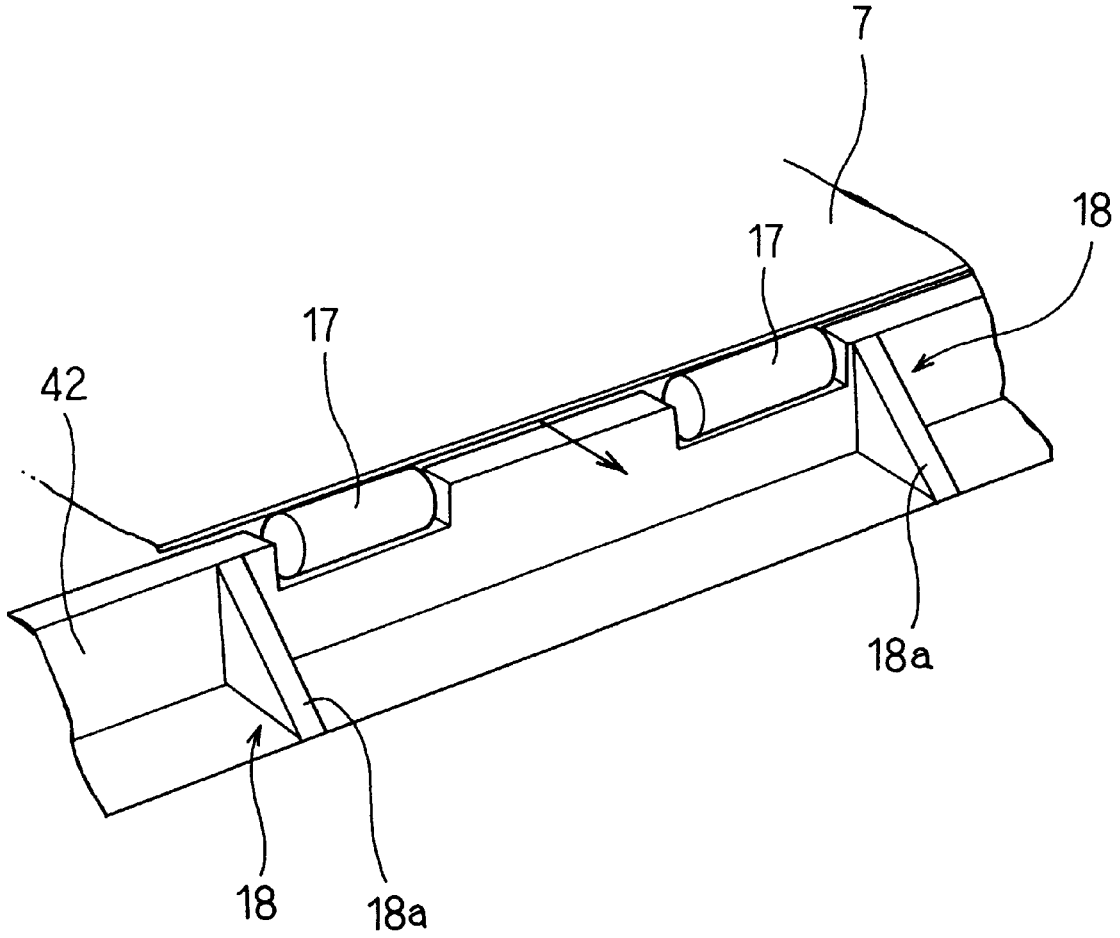
FIG. 4 is a partial enlarged perspective view of the facsimile machine, showing holding portions and paper discharge rollers.

A portion of the second guide member 6*f* forwardly extending from the lower end of the front wall 6*c* of the paper retaining frame 6 constitutes a support portion 42 supporting the lower end side of the paper 7 discharged past the discharge rollers 17, as shown in FIG. 4. The lower discharge rollers 17 of the two pairs are rotatably mounted on a forward end of the support portion 42.

The front wall 6*c* is rearwardly inclined and serves as a paper receiving plate on which the paper 7 whose lower end is supported by the support portion 42 is received. The support portion 42 includes two support members 18 disposed at opposite ends thereof. The lower discharge rollers 17 are positioned between the support members 18 so that the support members are disposed near the rollers 17 respectively. Each support member 18 has a flat face 18*a* crossing the front wall 6*c*.

A control circuit 35 serving as control means is provided on a bottom of the accommodation frame 2 for controlling the image reader 22, the printer 36, and various rollers such as the paper feed roller 8 and the paper discharge rollers 17. Furthermore, the control circuit 35 performs processes for reading images in the image reader 22, printing processes in the printer 36, processes for transmitting and receiving image information via the telephone line. Additionally, the above-mentioned paper sensor delivers the detection signal indicative of the pass of the paper 7 to the control circuit 35.

The operation of the facsimile machine will now be described. When the facsimile machine receives image information via the telephone line, a process for correcting inclination of the paper 7 is first executed. In the process, only the paper feed roller 8 is rotated with the other rollers being stopped, thereby feeding one sheet of paper 7 toward the paper inlet 6*b*. The paper 7 is guided by the distal end 6*h* of the first guide member 6*e* and the top 6*g* of the second guide member 6*f* so that the paper 7 is fed toward the holding point A in the direction of the tangential line of the platen roller 10 at the holding point, being gently curved.

In the above-described state, the ink ribbon 13 is stopped with its portion held at the holding point A and its rear portion extending in the direction of the tangential line of the platen roller 10 at the point. The film member 15 rests on the upper side of the ink ribbon 13 from its portion in the rear of the holding point A to its another portion below the front end of the first guide member 6*e*. Accordingly, the paper 7 is guided by the first and second guide members 6*e* and 6*f* toward the holding point A so that the printing side of the paper 7 advances along the upper face of the film member 15. Furthermore, the paper 7 is reliably fed in the direction of the tangential line of the platen roller 10 at the holding point A, reaching a location between the platen roller 10 and the print head 11.

The forward end of the paper 7 is abutted against the platen roller 10 before the backside thereof is abutted against the platen roller. Consequently, the forward end of the paper 7 is normally fixed at a predetermined position in the vicinity of the holding point A even when the thickness of the paper 7 varies or the paper 7 is partially rolled. Furthermore, since the film member 15 prevents the paper 7 from coming into contact with the ink ribbon 13 before the holding point A, the paper 7 can be prevented from becoming dirty.

When the paper 7 is fed by the paper feed roller 8, the forward end thereof is abutted against the paper detecting member 37, thereby rotatively moving the latter. The paper sensor detects the rotative movement of the paper detecting member 37 to thereby deliver the detection signal to the control circuit 35. Upon receipt of the detection signal, the control circuit 35 starts a counting operation to obtain an amount of feed of the paper 7 on the basis of the count and a feed speed of the paper feed roller 8. Based on the obtained amount of feed, the control circuit 35 rotates the paper feed roller 8 by a predetermined amount so that the paper 7 is flexed by a predetermined amount. As a result, the entire forward end of the paper 7 is abutted against the platen roller 10. The paper feed roller 8 and the control circuit 35 thus constitute paper inclination correcting means.

The printing process starts upon completion of the paper inclination correcting process as described above. The control circuit 35 starts rotation of the platen roller 10 and re-starts drive of the paper feed roller 8 so that the paper 7 is further fed. Furthermore, the unwinding roller 14*a* and the winding roller 14*b* are rotated in synchronism with rotation of the platen roller 10 so that the ink ribbon 13 is wound. As a result, the ink of the ink ribbon 13 is subjected to heat from the print head 11 such that the image information is printed on the printing side of the paper 7. The ink ribbon 13, after having passed the holding point A, is wound on the winding roller 14*b*. The paper 7 on which the image information has been printed is fed past the holding point A toward the paper discharge guide 16. The paper 7 is then guided by the paper discharge guide 16 and fed by the paper discharge rollers 17 out of the outlet 4*b* to be received on the front wall 6*c* of the paper accommodation frame 6.

Figure 5:
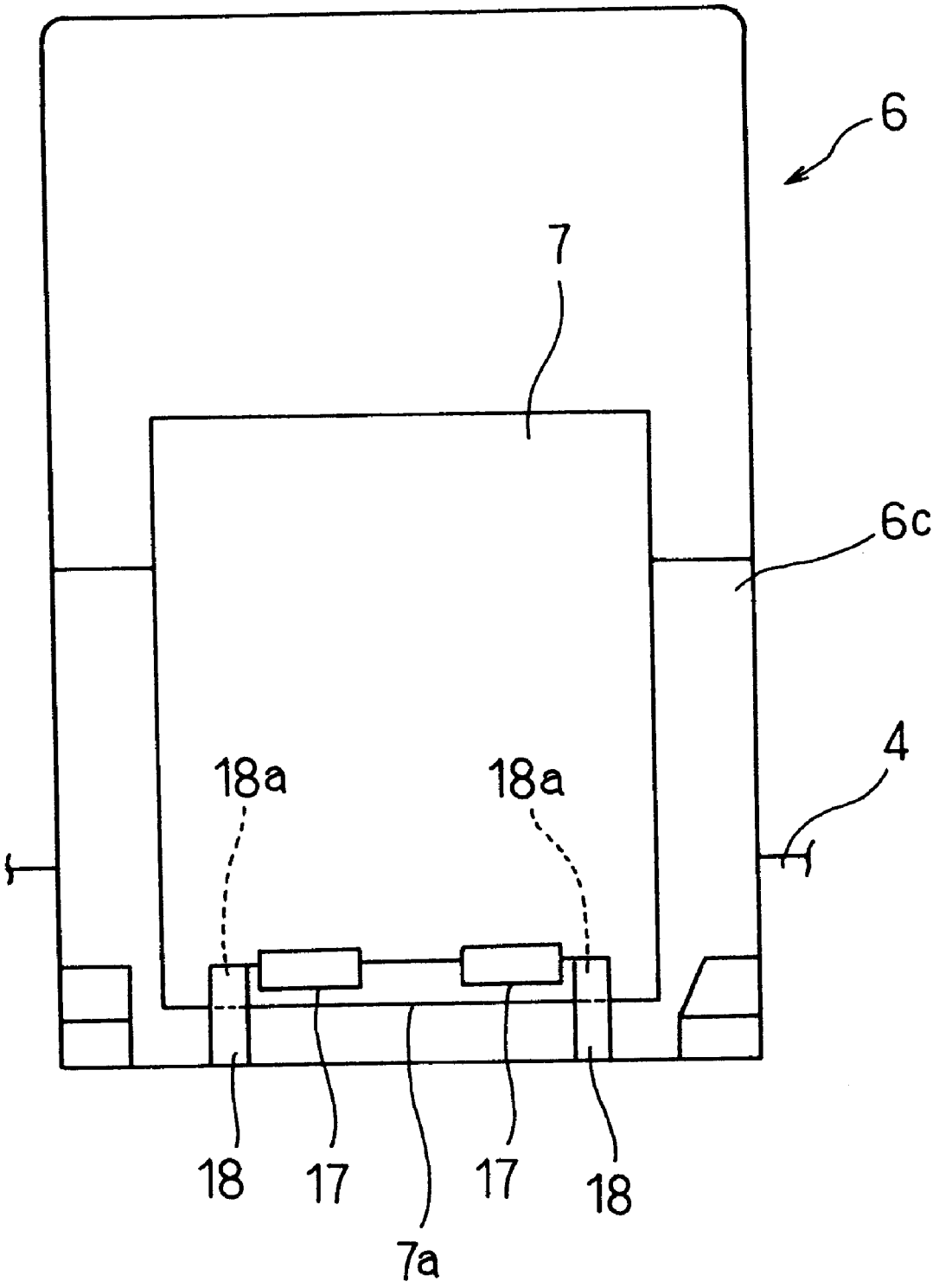
FIG. 5 is a front view of a paper accommodation frame of the facsimile machine, showing the condition where the paper is placed upright in the frame.
Figure 6:
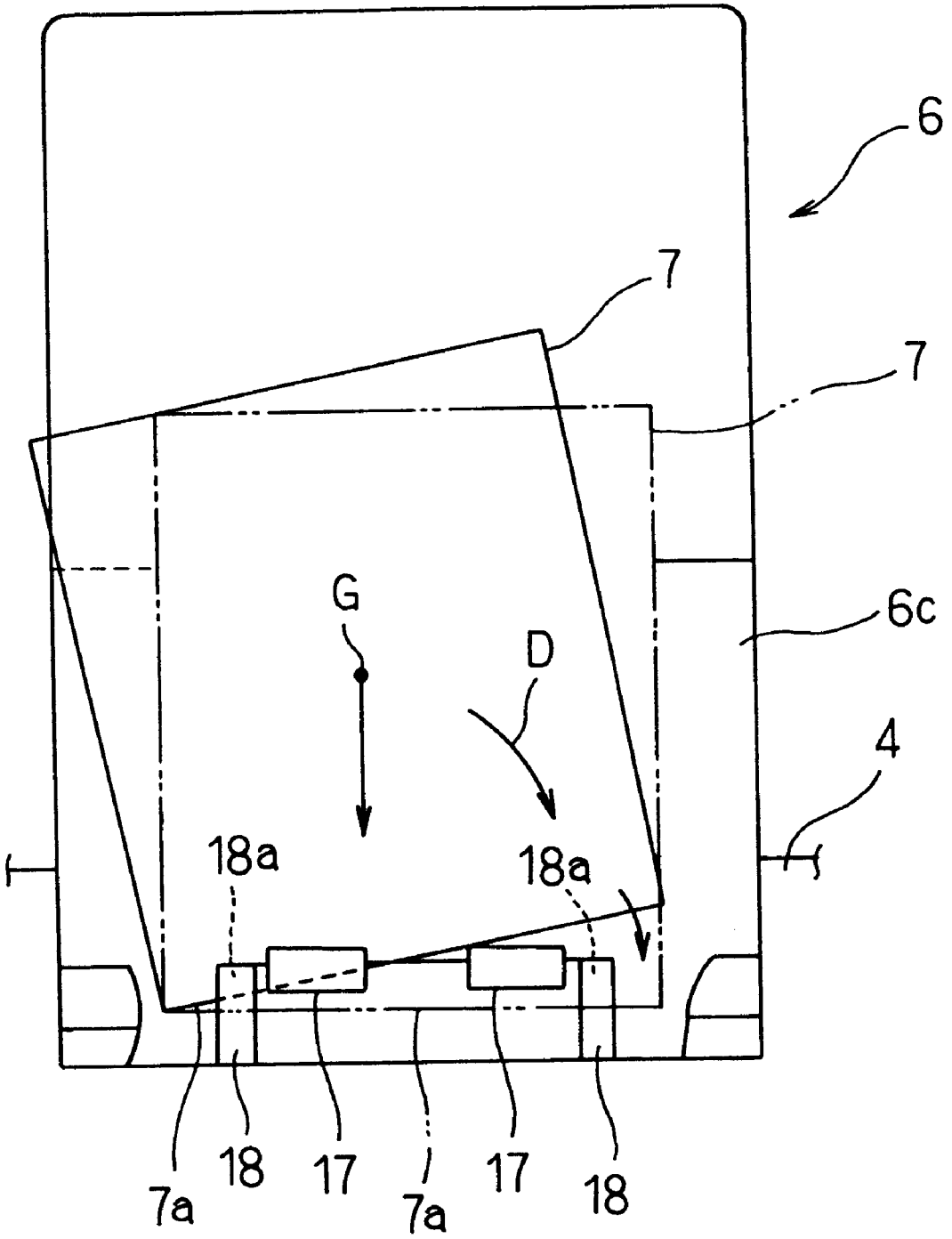
FIG. 6 is a front view of the paper accommodation frame, explaining the correction of inclination of the paper.

When fed out of the paper outlet 4*b* without inclination, the paper 7 is straightforwardly received on the front wall 6*c*, as shown in FIG. 5. A rear or lower end 7*a* of the paper 7 is supported by both flat faces 18*a* of the respective support members 18. On the other hand, when the paper 7 is fed out of the paper outlet 4*b* onto the front wall 6*c* in the inclined state, the lower end 7*a* of the paper 7 is supported by one of the support members 18, as shown in FIG. 6 which shows the case where the lower end 7*a* is supported only by the left-hand support member 18. In this case, the center of gravity G of the paper 7 is located in the right of the portion thereof supported by the support member 18. The gravity or self-weight causes the paper 7 to rotate in the direction of arrow D about the support member 18. Consequently, the inclination of the paper 7 is corrected such that the paper 7 is supported by both support members 18 in the straightforward state. Particularly in the embodiment, the support members 18 are disposed in the vicinity of the respective lower paper discharge rollers 17. Accordingly, each support member 18 can support a portion of the lower end of the paper 7 held between the paper discharge rollers 17, namely, a portion near the relatively strongly discharged portion of the paper 7. As a result, a number of sheets of paper 7 sequentially discharged out of the paper outlet 4*b* by the paper discharge rollers 17 can be received on the front wall 6*c* one upon another in the straightforward state.

On the other hand, if discharged in the inclined state without the support members 18 of the support portion 42, the paper 7 is supported only at one of four corners thereof by the support portion 42. In this case, the paper 7 is bent near the supported corner thereof. The bent portion of the paper 7 adheres closely to the support portion 42. Consequently, the paper 7 can be prevented from being rotatively moved so that the inclination thereof cannot be corrected. When the paper 7 is received on the front wall 6*c* in the inclined state, the forward or upper end of the subsequently discharged paper 7 abuts against the lower end of the inclined paper 7 to thereby push it. As a result, the sheets of paper 7 cannot be received on the front wall 6*c* one upon another. In the embodiment, however, the sheets of paper 7 on which the image information has been printed can be received on the front wall 6*c* one upon another in the straightforward state as the result of provision of the support members 18 of the support section 42.

According to the above-described embodiment, the forward end of the paper 7 is fixed by the print head 11 and the platen roller 10 when the inclination thereof is corrected. Accordingly, the embodiment can reduce the number of parts of the printer as compared with the conventional construction in which the resist roller issued to fix the forward end of the paper. Consequently, the manufacturing cost of the printer can be reduced. Furthermore, the forward end of the paper 7 is in abutment against the platen roller 10 and is located in the vicinity of the holding point A when the feed of the paper is restarted after completion of correction of inclination thereof. Accordingly, the printing start timing can readily be synchronized with the timing for driving the platen roller 10 for the feed of the paper 7. Consequently, the accuracy in the positioning for the printing can be improved, and the ink ribbon can be prevented from being wasted.

In the foregoing embodiment, the timing for starting the rotation of the platen roller 10 is synchronized with the timing for starting the drive of the unwinding and winding rollers 14*a* and 14*b* for the ink ribbon 13. Accordingly, since the timing for starting the feed of the paper 7 reliably agrees with the timing for starting the feed of the ink ribbon 13, the waste of ink ribbon can further be prevented. Furthermore, the rotation of the platen roller 10, the unwinding and winding rollers 14*a* and 14*b* is started on the basis of abutment of the entire forward end of the paper 7 against the platen roller. Consequently, since the paper 7 is fed to the holding point A when the process for correcting an inclination of the paper 7 has been completed, the image information can reliably be prevented from being printed on the paper 7 in the inclined state.

In the foregoing embodiment, the rotation of the platen roller is interrupted when the forward end of the paper 7 is fixed. Accordingly, a drive system and a control system for the resist roller in the conventional construction can be diverted to a drive system and a control system for the platen roller in the adjustment of paper inclination. Consequently, designing and development costs can be reduced.

The amount of flexure of the paper 7 is set for the predetermined value on the basis of the detection signal delivered by the paper sensor. As a result, since the amount of flexure of paper 7 is rendered constant when the feed of paper is started, the accuracy in determining the printing position can further be improved.

In the foregoing embodiment, the first and second guide members 6*e* and 6*f* are provided so that the paper 7 is fed toward the holding point A in the direction of the tangential line of the platen roller 10 at the point. Accordingly, since the paper 7 is reliably fed in the above-mentioned direction, the forward end of the paper can reliably be fixed between the platen roller 10 and the print head 11 in the vicinity of the holding point A even when the thickness of the paper 7 varies or the paper 7 is partially rolled. Consequently, the timing for starting the feed of paper 7 and the timing for starting the printing can readily be adjusted.

Furthermore, the ink ribbon 13 is fed tangentially at the holding point A, and the first and second guide members 6*e* and 6*f* guide the paper 7 to the holding point A so that the paper 7 is fed along the ink ribbon 13. Since the film member 15 is interposed between the paper 7 and the ink ribbon 13, the paper 7 can be prevented from being soiled by the ink ribbon 13.

Although the invention is applied to the printer of the facsimile machine in the foregoing embodiment, the invention may be applied to copying machines or printers connected to personal computers or the like.

Although the image sensor 25 comprises the CIS in the foregoing embodiment, it may comprise a charge coupled device (CCD), instead.

Although the ink ribbon 13 is fed in the same direction as the direction of feed of the paper 7 in the foregoing embodiment, the ink ribbon may be fed in a direction crossing the direction in which the paper is fed, instead.

In the foregoing embodiment, the guide means comprises the first and second guide members 6*e* and 6*f*. However, the guide means may comprise a single, three or more guide members, instead. Furthermore, the first and second guide members 6*e* and 6*f* may be integrally formed.

The distal end of the paper 7 may be fixed between the platen roller 10 and the print head 11 with the platen roller being rotated so that the inclination of the paper 7 is corrected. In this case, when the rotational speed of the paper feed roller 8 is increased relative to that of the platen roller 10, the paper 7 fixed between the platen roller 10 and the print head 11 can be flexed.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

We claim:

1. A printer comprising:

a platen roller;

a print head holding paper between the print head and the platen roller, thereby printing images on the paper; and paper inclination correcting means for feeding the paper while a forward end of the paper is being held between the platen roller and the print head so that the paper is flexed while being held between the platen roller and the print head, thereby correcting an inclination of the paper.

2. A printer according to claim 1, wherein the paper inclination correcting means has a function of interrupting rotation of the platen roller when the forward end of the paper is held between the platen roller and the print head.

3. A printer according to claim 2, further comprising winding means for winding an ink ribbon and control means releasing the forward end of the paper from a fixed state by the paper inclination correcting means and synchronizing a rotation start timing of the platen roller with a winding start timing of the winding means.

4. A printer according to claim 2, further comprising winding means for winding an ink ribbon and control means releasing the forward end of the paper, based on that a forward end side of the paper extends along the platen roller, and synchronizing a rotation start timing of the platen roller with a winding start timing of the winding means.

5. A printer according to claim 4, which further comprises paper detecting means provided midway in a feed passage of the paper to the platen roller for detecting pass of the paper therethrough, thereby generating a detection signal, and wherein the control means obtains an amount of flexure of the paper, based on the detection signal generated by the paper detecting means.

6. A printer according to claim 1, further comprising guide means for guiding the paper so that the paper is fed in a direction of a tangential line of the platen roller at a holding point where the paper and an ink ribbon are held between the platen roller and the print head, toward the holding point.

7. A printer according to claim 6, wherein the guide means comprises a first guide member having an abutment portion abutted against one of opposite sides of the paper located at the ink ribbon side and a second guide member having an abutment portion abutted against the other side of the paper, and wherein the abutment portion of the second guide member is located between the abutment portion of the first guide member and the platen roller.

8. A printer according to claim 7, which further comprises a paper feed roller, and wherein the abutment portion of the first guide member is located at one side of a plane defined between the holding point and the forward end of the paper fed past the paper feed roller and the abutment portion of the second guide member is located at the other side of the plane.

9. A printer according to claim 6, wherein the guide means guides the paper to the holding point substantially parallel with the ink ribbon.

10. A printer according to claim 9, further comprising a film member disposed to extend from a location near the holding point at least to another location where the paper is substantially parallel with the ink ribbon.

11. A printer comprising:

a platen roller;

a print head holding paper between the print head and the platen roller, thereby printing images on the paper;

guide means for guiding the paper so that the paper is fed in a direction of a tangential line of the platen roller at a holding point where the paper and an ink ribbon are held between the platen roller and the print head, toward the holding point; and paper inclination correcting means for feeding the paper while a forward end of the paper is being held between the platen roller and the print head so that the paper is flexed when being held between the platen roller and print head, thereby correcting an inclination of the paper.

* * * * *